US005619971A

United States Patent [19]

Kubo et al.

[11] Patent Number: 5,619,971

[45] Date of Patent: Apr. 15, 1997

[54] DISTRIBUTOR-TYPE FUEL INJECTION PUMP

[75] Inventors: Kenichi Kubo; Tsunayoshi Motoyoshi; Jun Matsubara; Kazuaki Narikiyo; Kazuo Inoue, all of Higashimatsuyama, Japan

[73] Assignee: Zexel Corporation, Tokyo, Japan

[21] Appl. No.: 490,839

[22] Filed: Jun. 15, 1995

[30] Foreign Application Priority Data

Jun. 16, 1994 [JP] Japan ..... 6-157985
Nov. 28, 1994 [JP] Japan ..... 6-317567

[51] Int. Cl.[6] ..... F02M 37/04

[52] U.S. Cl. ..... 123/450; 123/41.31; 417/462

[58] Field of Search ..... 123/41.31, 450, 123/502, 449; 417/228, 366, 462, 273

[56] References Cited

U.S. PATENT DOCUMENTS

| | | | |
|---|---|---|---|
| 2,515,033 | 7/1950 | Connor | 417/228 |
| 2,716,944 | 9/1955 | Ferris | 417/228 |
| 2,775,233 | 12/1956 | Bischoff | 123/450 |
| 2,910,976 | 11/1959 | Fancher | 123/502 |
| 4,430,047 | 2/1984 | Ilg | 417/273 |
| 4,438,747 | 3/1984 | Skinner | 123/450 |
| 4,480,623 | 11/1984 | Thomas | 123/41.31 |
| 4,531,488 | 7/1985 | Kawamura et al. . | |
| 4,601,274 | 7/1986 | Seilly | 123/450 |
| 4,625,694 | 12/1986 | Adey | 123/450 |
| 4,915,592 | 4/1990 | Hishinuma | 417/462 |
| 5,354,183 | 10/1994 | Eisenbacher | 417/366 |

FOREIGN PATENT DOCUMENTS

| | | | |
|---|---|---|---|
| 0524132 | 1/1993 | European Pat. Off. . | |
| 561475 | 4/1957 | Italy | 123/450 |
| 59-110835 | 6/1984 | Japan . | |
| 2104964 | 4/1990 | Japan . | |
| 860015 | 2/1961 | United Kingdom | 123/450 |

*Primary Examiner*—Carl S. Miller
*Attorney, Agent, or Firm*—Wenderoth, Lind & Ponack

[57] ABSTRACT

The inside of the housing is divided into a low pressure fuel area formed from a fuel inflow port through a feed pump 4 and a high pressure fuel area that can communicate with inflow/outflow ports for fuel. For instance, the low pressure fuel area may be formed as a path extending from the fuel intake port that communicates with the circumferential area of the front end of the rotor to the feed pump via the circumferential area of the rotor support member and a passage for inducing fuel from the high pressure fuel area to the circumferential area of the front end of the rotor may be formed between the rotor and its support member. The flow of fuel in the area where the rotor slides in contact with its support member is ensured, and oil film loss is prevented. With this, cooling and good lubrication in the rotor sliding contact area, where heat is likely to be generated, are promoted, to prevent seizure in the sliding contact area. Also, ports that open into the area where the rotor slides in contact with its support member and that communicates with the compression space may be provided in the rotor so that compressed fuel is supplied directly to the sliding contact area.

17 Claims, 10 Drawing Sheets

DISTRIBUTOR-TYPE FUEL INJECTION PUMP

BACKGROUND OF THE INVENTION

1. Field of the Invention

The present invention relates to an innercam system, distributor-type fuel injection pump used for supplying fuel to engines, i.e., to a fuel injection pump which adopts a method whereby plungers are caused to make reciprocal movement in the direction of the radius of a rotor that rotates in synchronization with the engine.

2. Description of the Related Art

Innercam system, distributor-type fuel injection pumps of this type in the known art include the pump disclosed in Japanese Unexamined Patent Publication No. S59-110835. In this pump, an innercam ring 1 is provided concentrically around a fuel distribution rotor 4 (rotor) inside a fuel chamber 121 (chamber). Force feed plungers 21 and 22 are provided on the cam surfaces formed on the inside of the innercam ring 1 via rolling bodies 23 and 24 (rollers) and shoes 25 and 26 and these force feed plungers 21 and 22 are caused to make reciprocal movement in the direction of the radius of the fuel distribution rotor 4. A pump chamber 2 (compression space) whose volumetric capacity changes with the movement of the force feed plungers 21 and 22, intake ports 51–54 for taking in fuel to the pump chamber 2 during the intake process, a distribution port 6 for delivering fuel that has been pressurized in the pump chamber 2 during the force feed process, and overflow ports 71–74 for cutting off delivery of fuel are formed at the fuel distribution rotor 4. A ring-shaped member 7 (control sleeve) is externally fitted on the rotor with a high degree of oil tightness, covering the overflow ports 71–74 and by adjusting the position of this ring-shaped member 7 in the direction of the axis, the cutoff timing (the timing with which the compressed fuel flows out to the fuel chamber 121) during the force feed process is changed, thereby changing the fuel injection quantity.

As a result of a great deal of research performed on innercam system, distributor-type fuel injection pumps of this type, the inventor of the present invention has learned that if intake ports and cutoff ports are made to open into the area where the pressure is somewhat higher than the pressure around the rollers and shoes, fuel intake into the compression space is facilitated due to the pressure difference between the ends of the plungers. The plungers can be made to move toward the outside due to this pressure difference and, at the same time, the rollers and the like can be cooled with the fuel in the low pressure fuel area. As a result, the inventor of the present invention and others have thought of partitioning the area on the upstream side of the feed pump, which includes the area surrounding the rollers, from the area on the downstream side of the feed pump, which communicates with the inflow/outflow ports of the rotor. This idea has resulted in the development of, for instance, the distributor-type fuel injection pump shown in FIG. 10.

In this distributor-type fuel injection pump, with a rotor support member 7 and an adaptor 9 which are secured inside a housing 2, the area surrounding the port 31, which takes in and cuts off fuel, is separated from the area where the rollers 25 and shoes 24 are provided, and by inserting a rotor 16 through the rotor support member 7 and the adaptor 9 with a high degree of oil tightness and in such a manner that it can rotate freely, pressure in the area surrounding the port 31 is maintained higher than the pressure around the rollers and the like. Note that in the figure, reference number 3 indicates a drive shaft for rotating and driving the rotor 16 and a feed pump 4. Reference number 26 indicates a cam ring for regulating the movement of the plungers 22 via the rollers 25 and the shoes 24. Reference number 33 indicates a distribution port for supplying fuel that has been compressed in a compression space 23 to a distribution passage 32. Reference number 34 is a control sleeve for adjusting the injection quantity and reference number 49 indicates a fuel inflow port for supplying fuel to the area where the rollers 25 and the like are provided.

However, in the injection pump structured as described above, it has been verified that the portion where the rotor 16 is in sliding contact with its support member tends to seize. This phenomenon is observed particularly in the area where the front end of the rotor 17 slides in contact, rather than at the base end (the portion where the rotor slides in contact with the rotor support member 7 in the distributor-type fuel injection pump shown in FIG. 10) and such seizure may occur even if that area is coated.

We are still looking into the specific causes of this, but we anticipate that when, for one reason or another, a rotational misalignment occurs in the rotor, the amount of heat generated in the area where it is in sliding contact, increases during high speed rotation. This reduces the viscosity of the fuel used for lubricating this sliding contact area, resulting in oil film loss, which, in turn, causes seizure. In addition, due to the high pressure fuel supplied to the distribution port, the surface of the rotor that comes in contact with the rotor support member at 180° from the distribution port will be under a high surface pressure. This may be calculated as (fuel pressure X opening area of the distribution port) and since this surface pressure increases when the discharge pressure is increased, this is also a possible cause of seizure between the rotor and the barrel.

SUMMARY OF THE INVENTION

Accordingly, the object of the present invention is to provide a distributor-type fuel injection pump with which cooling and good lubrication are promoted in the area of the rotor where it slides in contact, which tends to generate heat, to prevent seizure in the area.

After researching into various measures against seizure in the area where the rotor slides in contact with its support member, the inventor of the present invention has ascertained that if the heat generated in the area where the rotor slides in contact with the support member is efficiently removed by some means, reduction of the viscosity of the lubricating oil in this sliding contact area is reduced, resulting in improved lubrication and preventing oil film loss and that, if the fuel used as lubricating oil is actively supplied to the sliding contact area, oil film loss is likewise prevented, to improve lubrication, and this discovery has lead to the completion of the present invention.

The inventor of the present invention has also ascertained that the force applied to the rotor by the fuel supplied to the distribution port in the direction opposite the distribution port can be canceled out with an equal force applied toward the port and that by doing so, smooth sliding of the rotor against its support member can be assured. This discovery, too, has lead to the completion of the present invention.

Namely, the distributor-type fuel injection pump according to the present invention comprises: a rotor that rotates in synchronization with the engine, plungers that are provided in the direction of the radius of the rotor and which change the volumetric capacity of the compression space formed in the rotor and a cam ring that is provided concentrically to, and around the rotor, which regulates the movement of the plungers, all of which are provided inside a housing, and ports formed in the rotor that take in, distribute and cutoff fuel by communicating with the compression space. The inside of the housing is partitioned into a low pressure fuel area that ranges from a fuel inflow port to the upstream side of the feed pump and a high pressure fuel area into which the fuel pressurized by the feed pump is induced and which can communicate with the ports for taking in and cutting off fuel described earlier. A fuel flow path for cooling the area where the rotor slides in contact with its support member, is formed ranging from the high pressure fuel area through the low pressure fuel area.

In this pump, the low pressure fuel area may be formed ranging from the fuel inflow port, which faces the circumference of the front end of the rotor, through the upstream side of the feed pump via the circumference of the rotor support member and, at the same time, the fuel flow path may be formed between the rotor and the rotor support member to induce the fuel from the high pressure fuel area to the circumferential area of the front end of the rotor. In addition, the high pressure fuel area may be provided through the circumferential area of the front end of the rotor and, at the same time, the fuel flow path may be constituted of a passage which connects with the low pressure fuel area via the circumferential area of the front end of the rotor, to promote the flow of the fuel in the vicinity of the sliding contact area.

If a fuel flow path is to be formed between the rotor and its support member, it should be formed in such a manner that it does not interfere with the distribution port. At the same time, in order to avoid reduced pressure in the high pressure fuel area, a first flow passage, formed from the high pressure fuel area through a distribution passage, and a second flow passage, formed from a distribution passage through the low fuel pressure area, should be provided at different phases on the circumferential surface of the rotor. In addition, if the fuel flow path is to be formed through the low pressure fuel area via the circumferential area of the front end of the rotor, it is desirable to avoid reduction of pressure in the high pressure fuel area by constricting the passage area through such means as providing an orifice in the middle.

Furthermore, unlike in the structure described above, it is also possible to form ports that communicate with the compression space and, at the same time, open into the area where the rotor slides in contact with the support member. It is desirable that such ports open directly into the sliding contact area where seizure is likely to occur.

Moreover, the distributor-type fuel injection pump according to the present invention may also be provided with ports in the rotor whose phases are different from that of the port for fuel distribution by 180° in order to balance the forces working in the direction of the radius to press the rotor against the rotor support member. A plurality of such ports whose phases are different by 180° may be provided by offsetting them in the direction of the axis relative to the passage for discharge, which can communicate with the distribution port. In this case, the total of the opening areas of the plurality of ports whose phases are different by 180° should be made approximately equal to the total of the opening area of the distribution port.

As a means for balancing the forces working in the direction of the radius of the rotor, two ports, which are offset to the front and to the back symmetrically in the direction of the rotor circumference relative to the fuel distribution port, may be formed, and these two ports may be made to communicate with the distribution port at the center of the rotor so that when projected in the direction of the axis, they will together form a Y shape.

Consequently, according to the present invention, since a fuel flow path for cooling is formed in the area where the rotor slides in contact with the support member, ranging from the high pressure fuel area to the low pressure fuel area, the heat generated in the area where the rotor slides in contact with the support member is carried off by the fuel flowing through the fuel flow path, to prevent oil film loss and suppress any reduction in the viscosity of the lubricating oil, achieving the object described earlier.

In particular, if the low pressure fuel area is formed extending from the fuel inflow port, which faces the circumferential area of the front end of the rotor, through the upstream side of the feed pump and the fuel flow path is formed between the rotor and the support member so that fuel flows through the fuel flow path from the high pressure fuel area to the circumferential area of the front end of the rotor, the fuel flows through the area where the rotor slides in contact with the support member to remove the heat generated in that sliding contact area and, at the same time, as the rotor rotates, the fuel is led to the sliding contact area to promote lubrication in the sliding contact area.

In addition, if the high pressure fuel area is provided through the circumferential area of the front end of the rotor and the fuel flow path is formed through the low pressure fuel area via the circumferential area of the front end of the rotor, since the flow of fuel in the vicinity of the area where the rotor slides in contact with the support member is assured, cooling of the sliding contact area is promoted by the fuel that flows in the fuel flow path and the heat generated in the sliding contact area is removed, minimizing any reduction in the viscosity of the lubricating oil and preventing oil film loss, even though fuel is not actively supplied to the sliding contact area.

Furthermore, if the ports communicating with the compression space are provided in the rotor to open into the sliding contact area, the fuel compressed in the compression space is actively supplied to the sliding contact area to promote lubrication of the sliding contact area. In particular, as the pump rotation becomes faster, supply intervals of fuel being sent to the sliding contact area via the ports become shorter and, at the same time, the pressure of the fuel supplied to the sliding contact area becomes higher, achieving a varying lubrication capacity that corresponds to the load.

With the ports that communicate with the compression space being provided in the rotor at phases different from that of the distribution port by 180°, the force applied to the rotor by the fuel supplied to the distribution port toward the side opposite the distribution port is canceled out by the force applied by the fuel supplied to the ports whose phases are different by 180° toward the distribution port, to improve the pressure balance in the direction of the radius.

In this case, if there is a passage for discharge that can communicate with the distribution port formed in the area where the phase is different by 180°, the required injection quantity will not be achieved, since fuel will leak into that area. This problem can be solved by providing a plurality of ports that are offset to the front and the rear in the direction of the axis so that they will not communicate with this passage. This will make it possible to induce fuel into the intended passage only and this also achieves an improvement in the pressure balance in the direction of the axis as well as in the direction of the radius.

Moreover, by forming two ports which are offset symmetrically in the direction of the circumference relative to the distribution port and which communicate with the compression space, and by making these two ports communicate with the distribution port at the center of the rotor so that they will form a Y shape when projected in the direction of the axis, since fuel will work on three locations around the rotor, a balance of pressure in the direction of the radius is achieved even more accurately. In such a structure, in particular, since those ports form a Y shape overall, even though the two ports are provided on the same surface as the distribution port, the distribution port does not communicate with the discharge passage at the same time as the two ports.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings:

FIG. 11 shows an example of formation of the ports that are formed in the rotor of the distributor-type fuel injection pump according to the present invention. FIG. 12 shows another example of formation of the ports that are formed in the rotor of the distributor-type fuel injection pump according to the present invention.

DETAILED DESCRIPTION OF THE PREFERRED EMBODIMENTS

The following is a explanation of the embodiments of the present invention in reference to the drawings.

Figure 1:
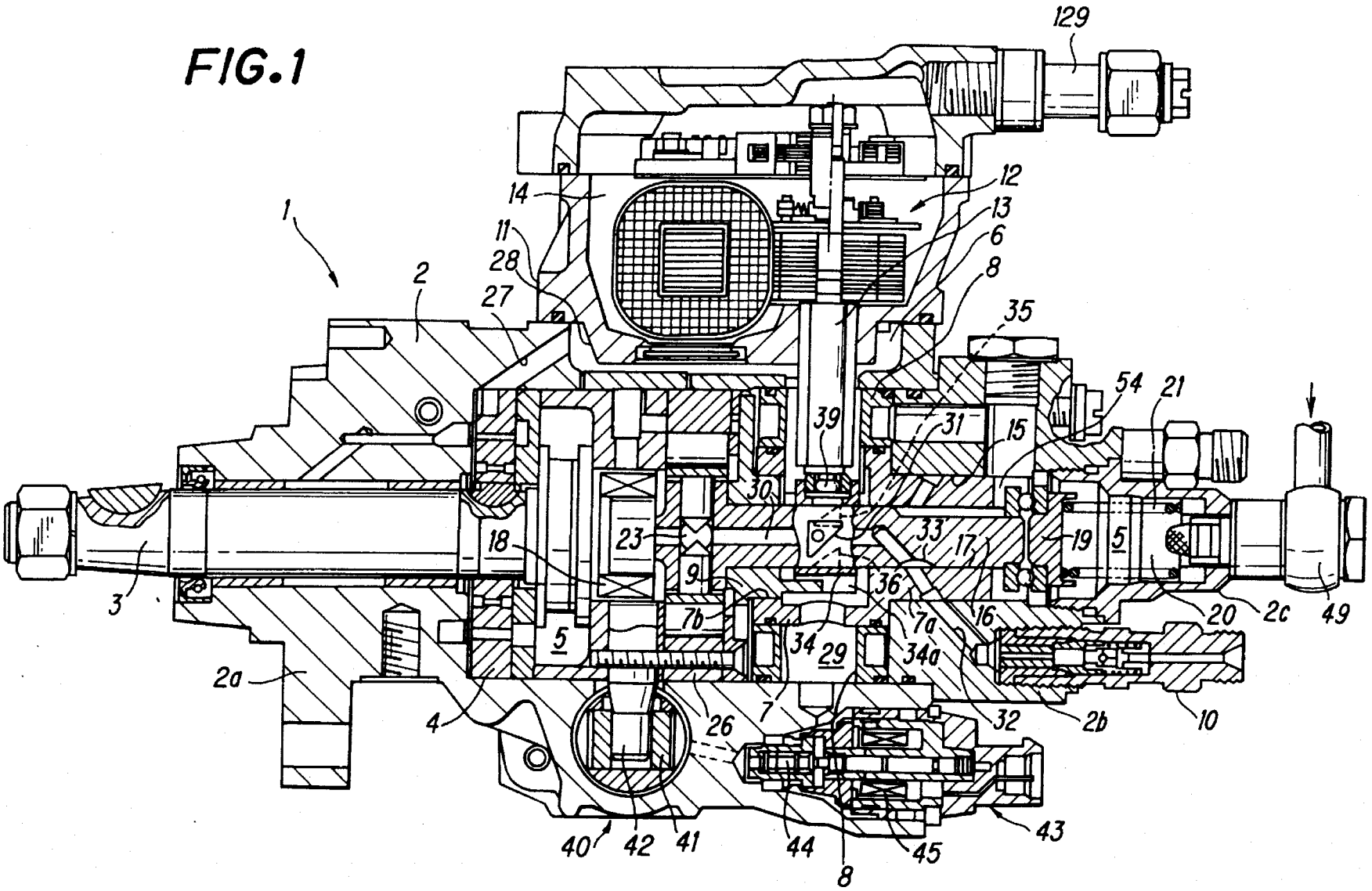
FIG. 1 is a cross section of a distributor-type fuel injection pump according to the present invention.

FIG. 1 shows an innercam system, distributor-type fuel injection pump 1. In the distributor-type fuel injection pump 1, a drive shaft 3 is inserted in a pump housing 2. One end of the drive shaft 3 projects out to the outside of the pump housing 3 to receive drive torque from the engine (not shown) so that it can rotate synchronously with the engine (at a rotation rate which is half the engine rotation rate). The other end of the drive shaft 3 extends into the pump housing 2. A feed pump 4 is linked to the drive shaft 3 and through this feed pump 4, fuel which is supplied via a low pressure area 5, which is to be explained later, is supplied to a chamber 29.

The pump housing 2 comprises a housing member 2*a* through which the drive shaft 3 passes, a housing member 2*b*, which is mounted on the housing member 2*a* and is provided with a delivery valve 10, and a housing member 2*c* which blocks the opening end of the housing member 2*b* and is provided on a line that extends from a rotor 16. The chamber 29 is constituted of a space that is enclosed by: a rotor support member 7, provided within the pump housing, a partitioning body 8, which holds the rotor support member 7 by passing through it and an adaptor 9, to be explained later, and it communicates with a governor housing chamber 14 which is bounded by a governor housing 11. The rotor support member 7 is provided with a projected portion for fitting 7*a* which is formed as a part of the rotor support member 7 at its side and which is inserted into an insertion hole 15 in the housing member 2*b*, which is provided with the delivery valve 10.

The rotor 16 passes through the support member 7, and its front end area is supported in a through hole 17 which is formed in the projected portion for fitting 7*a* with a high degree of oil tightness in such a manner that it can rotate freely. The bottom end of the rotor 16 is linked to the drive shaft 3 via a coupling 18. Consequently, the rotor 16 can rotate only with the rotation of the drive shaft 3. In addition, a spring housing chamber 20 is formed by partitioning between a spring receptacle 19 at the front end portion of the rotor 16 and the housing member 2*c*, and a spring 21 provided in the spring housing chamber 20 eliminates any play in the direction of the axis by applying a force to the rotor 16 toward the coupling.

Figure 2:
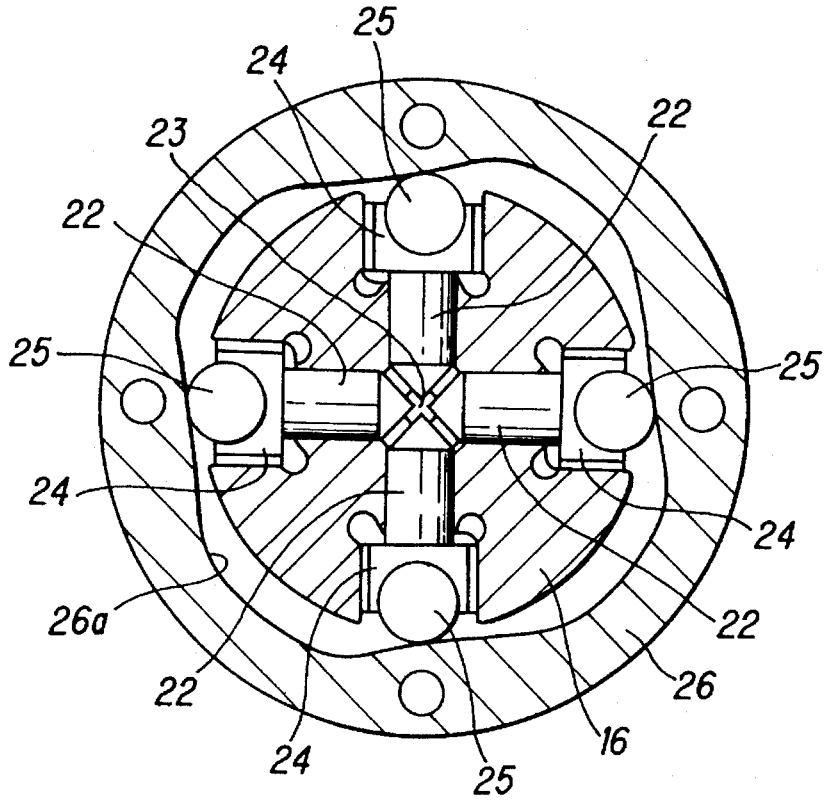
FIG. 2 is an enlarged cross section of the cam ring shown in FIG. 1 and the members inside it, viewed in the direction of the axis of the rotor.

At the bottom end of the rotor 16, as shown in FIG. 2, plungers 22 are inserted in the direction of the radius (the radial direction) in such a manner that they can slide freely. For instance, in this embodiment, four plungers 22 are provided with their phases at 90° to each other on the same plane, and the front end of each of the plungers 22 faces in, so as to seal off a compression space 23 provided at the center of the base end of the rotor 16. The base ends of the plungers 22 slide against the internal surface of a ring-like cam ring 26 via shoes 24 and rollers 25. The cam ring 26 is provided concentrically to, and on the circumference of the rotor 16 and has cam surfaces formed on its internal surface, the number of which corresponds to the number of cylinders in the engine. When the rotor 16 rotates, each of the plungers 22 makes a reciprocal movement in the direction of the radius (radial direction) of the rotor 16 to change the volumetric capacity of the compression space 23.

For instance, in order to correspond to four cylinders, a projected surface is formed every 90° on the inside of the cam ring 26. Consequently, the four plungers 22 move together to constrict the compression space 23 for compression, and they also move away from the center together.

A ring-like adaptor 9 is externally fitted on the rotor 16 with a high degree of oil tightness in such a manner that it can rotate freely. Part of the circumferential edge of the adaptor 9 is connected and held by the cam ring 26 so that its rotation is restricted, and it rotates along with the cam ring 26. The adaptor 9 is inserted and fitted in a fitting hole **7*b* which is formed in the rotor support member 7** with a high degree of oil tightness in such a manner that it can rotate freely.

A fuel inflow port 49, which communicates with the fuel tank, is formed in the housing member **2*c* on a line extended from the rotor 16 and fuel that flows in through the fuel inflow port 49 travels through the spring housing chamber 20, the circumferential area of the rotor front end 54 and is induced toward the intake side of the feed pump 4 via the space formed around the partitioning member 8, the rotor support member and the adaptor 9, the space formed between the cam ring 26 and the rotor 16, a passage formed around the coupling 18 and the like. These spaces and the passage constitute a low pressure fuel area 5, which extends from the fuel inflow port 49 through the feed pump 4**.

The fuel compressed by the feed pump 4 is induced into the chamber 29 via a passage 27 formed in the upper portion of the pump housing and a gap 28 formed between the pump housing 2 and the governor housing 11 which is mounted on the pump housing 2. The compressed fuel also travels through the governor housing chamber 14 to an overflow valve 129. These members that communicate with each other constitute a high pressure fuel area 6.

A longitudinal hole 30, which communicates with the compression space 23 is formed in the rotor 16 in the direction of its axis. The rotor 16 is also provided with an inflow/outflow port 31 which communicates with the longitudinal hole 30 and also opens on to the circumferential surface of the rotor 16, and a distribution port 33 which makes possible communication between a distribution passage 32 formed in the rotor support member 7 and the housing **2*b*, and the longitudinal hole 30. The portion of the inflow/outflow port 31 which opens on the surface of the rotor 16 is formed in a triangular shape with the side toward the rear in the direction of rotation running parallel to the direction of the axis of the rotor 16 and the side toward the front forming the hypotenuse, which is inclined at a specific angle in relation to the direction of the axis of the rotor 16. In addition, a control sleeve 34 is externally fitted on the rotor 16 covering the inflow/outflow port 31** in such a manner that it can slide freely.

As shown in FIG. 4, intake/cutoff holes 35 and 36, which can communicate with the inflow/outflow port 31, are formed in the control sleeve 34. The intake/cutoff holes 35 and 36 are each formed in a triangular shape with the side that determines the timing with which communication with the inflow/outflow port 31 starts constituting the hypotenuse, which is inclined at a specific angle in relation to the direction of the axis of the rotor 16 and the side that determines the timing with which communication with the inflow/outflow port 31 ends running parallel to the direction of the axis of the rotor 16.

Figure 4A:
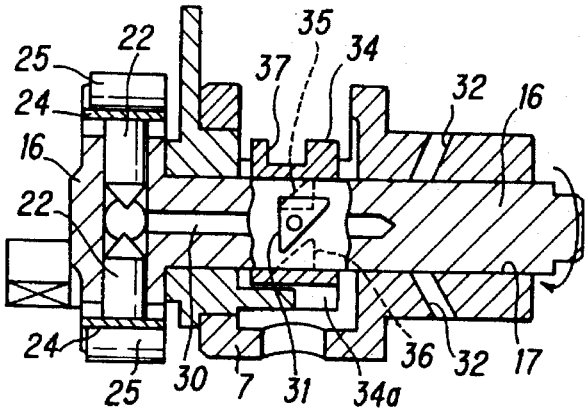
FIGS. 4A, 4B and 4C respectively illustrate the fuel intake process, the force feed process and the cutoff process.

Consequently, when the rotor 16 rotates, the inflow/outflow port 31 comes into communication with the intake/cutoff holes 35 and 36 sequentially and during an intake process, in which the plungers 22 move away from the center of the cam ring 26, the inflow/outflow port 31 is aligned with the intake/cutoff hole 35 to take in the fuel from the chamber 29 to the compression space 23 (see FIG. 4A).

Figure 4B:
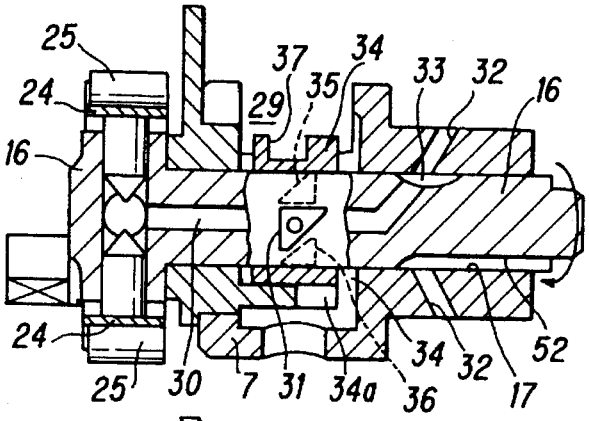

After that, when the operation enters the force feed process, in which the plungers 22 move toward the center of the cam ring 26, communication between the inflow/outflow port 31 and the intake/cutoff hole 35 is cut off and the distribution port 33 becomes aligned with one of the distribution passages 32 so that the compressed fuel is sent out to the delivery valve 10 via a distribution passage 32 (see FIG. 4B).

Note that the fuel delivered from the delivery valve 10 is sent to an injection nozzle via an injection tube (not shown) to be injected into a cylinder of the engine from the injection nozzle.

Figure 4C:
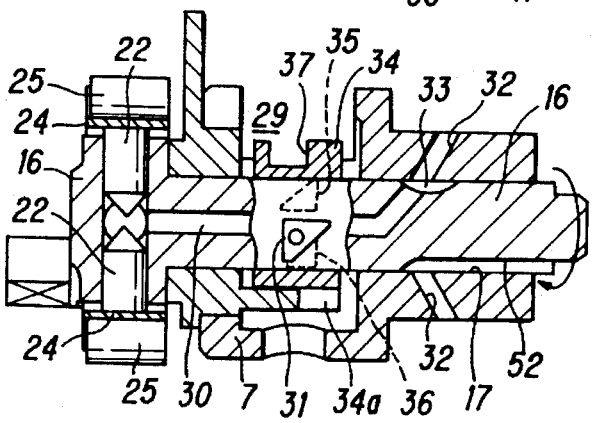

Then, when the inflow/outflow port 31 comes into communication with the intake/cutoff hole 36 during the force feed process, the compressed fuel flows out into the chamber 29, stopping the supply to the injection nozzle to end injection (see FIG. 4C).

Figure 5:
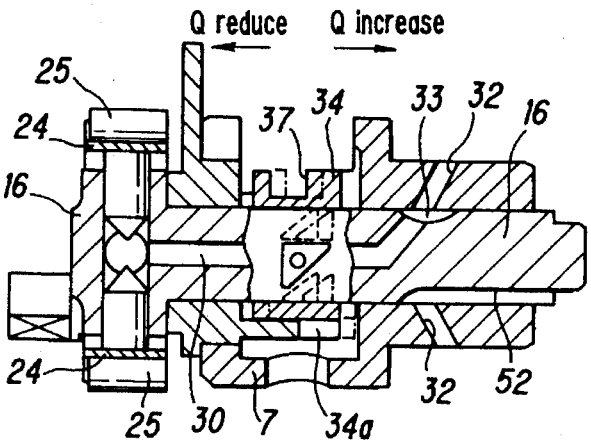
FIG. 5 illustrates how the injection quantity changes when the control sleeve is adjusted.

Since the inflow/outflow port 31 and the intake/cutoff holes 35 and 36 are formed in triangular shapes as explained earlier, the timing with which communication between the inflow/outflow port 31 and the intake/cutoff hole 35 is cut off does not change, regardless of the position of the control sleeve 34. However, the timing with which the inflow/outflow port 31 comes into communication with the intake/cutoff hole 36 does change, depending upon the position of the control sleeve 34 (see FIG. 5). As a result, the injection end, i.e., the injection quantity, can be adjusted through the positional adjustment of the control sleeve 34. As the control sleeve 34 is moved to the left in the figure (toward the base end of the rotor 16), the injection quantity is reduced and as it is moved to the right (toward the front end of the rotor 16), the injection quantity is increased.

Now, a linking groove 37 is formed in the direction of the circumference of the upper surface of the control sleeve 34 over a specific angle range and a ball 39, which is formed at the front end of the shaft 13 of an electric governor 12, is connected and held in the linking groove 37. The ball 39 is provided by decentering from the shaft 13 and when the shaft 13 rotates in response to a signal from the outside, the control sleeve 34 is caused to move in the direction of the axis of the rotor 16.

Also, a groove **34*a*, which extends in the direction of the axis, is formed below the control sleeve 34 and a part of the adaptor 9 is connected and held in this groove 34*a* to maintain the phase relationship between the adaptor 9 and the control sleeve 34** constant at all times.

The timer apparatus 40 houses a timer piston 41 in such a manner that it can slide freely in a cylinder which is provided in the lower portion of the pump housing 2. The timer piston 41 is linked to the cam ring 26 via a lever 42 to adjust the injection timing by converting the movement of the timer piston 41 to rotation of the cam ring 26.

A high pressure chamber into which high pressure fuel in the high pressure fuel area 6 is induced is formed at one end and a low pressure chamber that communicates with the low pressure fuel area 5 is formed at the other end of the timer piston 41. Furthermore, a timer spring is provided in the low pressure chamber to apply a constant force to the timer piston 41 toward the high pressure chamber. As a result, the timer piston 41 stops at a position where the spring pressure of the timer spring and the fuel pressure inside the high pressure chamber are in balance. When the pressure in the high pressure chamber increases, the timer piston 41 moves toward the low pressure chamber in resistance to the timer spring to rotate the cam ring 26 in the direction that hastens the injection timing, to advance the injection timing. In contrast, when the pressure in the high pressure chamber is lowered, the timer piston 41 moves toward the high pressure chamber to rotate the cam ring 26 in the direction that delays the injection timing, to retard the injection timing.

Note that the pressure in the high pressure chamber of the timer is adjusted by a timing control valve (TCV) 43 to achieve the required timer advance angle. An entrance portion that communicates with the chamber 29 and the high pressure chamber side of the timer piston 41 is formed at the side of the timing control valve 43 and an exit portion that communicates with the low pressure chamber side of the timer piston 41 is formed at its front end. Inside the valve, a needle 44 is housed, which opens and closes communication between the entrance portion and the exit portion. A constant force is applied to the needle 44 by a spring in the direction that cuts off communication between the entrance portion and the exit portion and when power is supplied to a solenoid 45, it is pulled in resistance against the spring, in the direction in which the entrance portion comes into communication with the exit portion so that the high pressure chamber communicates with the low pressure chamber.

Consequently, when no electric current is running to the solenoid 45, the high pressure chamber is completely cut off from the low pressure chamber, but when electric current is running to the solenoid 45, the high pressure chamber and the low pressure chamber are in communication, to reduce the pressure in the high pressure chamber. Thus, as the pressure in the high pressure chamber changes, the timer piston 41 moves to a position where it is in balance with the spring force of the timer spring, which rotates the cam ring 26 to change the injection timing. Note that the timing control valve 43 should be controlled through duty ratio control.

Figure 3:
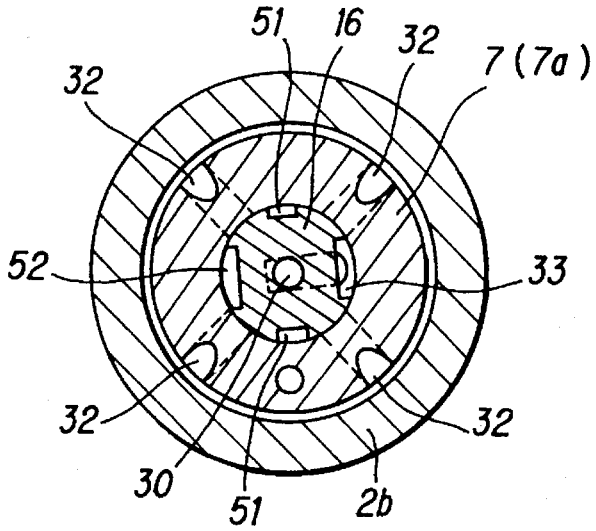
FIG. 3 is an enlarged cross section of the rotor front end and the rotor support member.

Now, as shown in FIGS. 3 and 6, first and second flow passages 51 and 52 are formed in the area where the rotor 16 slides in contact with the rotor support member 7. The following is an explanation of these passages. The first and second flow passages 51 and 52 are constituted by using the portion of the circumferential surface of the rotor 16 where the distribution port 33 is not formed. To be more specific; the first flow passages 51 are formed at two locations whose phases are offset by 90° to the front and to the rear relative to the distribution port 33 and the second flow passage is formed at a position whose phase is offset by 180° relative to the distribution port 33.

The first flow passages 51 are formed along the direction of the axis of the rotor, for instance, at a length such that they can communicate between the chamber 29 (high pressure fuel area 6) and the distribution passages 32. The second flow passage 52 is formed along the direction of the axis of the rotor, for instance, at a length such that it can communicate between the distribution passages 32 and the low pressure fuel area 5. In this embodiment, the depth and width dimensions of the first flow passages 51 are smaller than those of the second flow passage 52 to reduce the passage cross section. This is to ensure that, by thus increasing the passage resistance, the fuel pressure in the chamber 29 will not become reduced excessively.

In the structure described above, since the inside of the pump housing 2 is divided into the low pressure fuel area 5, to be filled with the low pressure, low temperature fuel that flows in from the fuel inflow port 49 and the high pressure fuel area 6, to be filled with fuel that is compressed by the feed pump 4 and that is maintained at a somewhat high pressure, and the low pressure, low temperature fuel that runs through the low pressure fuel area 5 and is sent to the feed pump 4 via the spring housing chamber 20 and the circumferential area of the rotor front end 54 flows through the area where the rotor 16 slides in contact with the support member 7 without becoming stagnant, an increase in the temperature at the sliding contact area can be inhibited with the low pressure fuel area 5 thus structured.

Figure 6A:
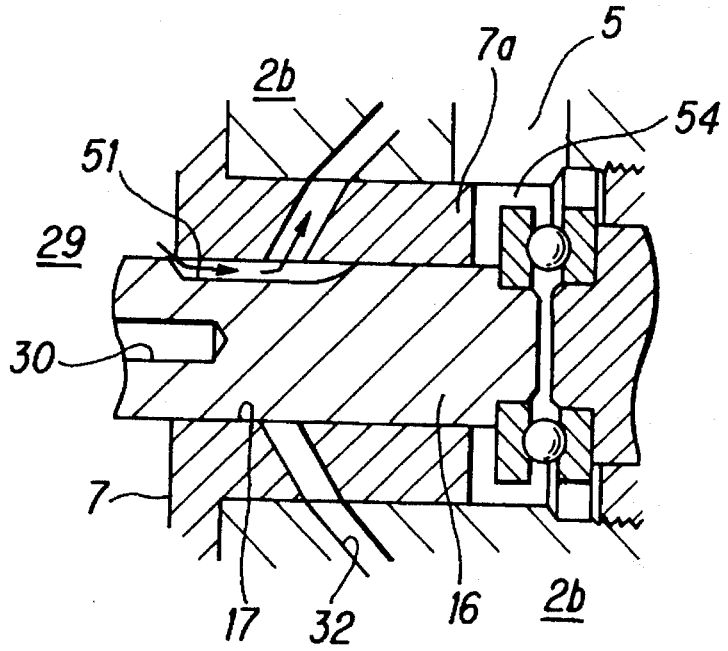
FIGS. 6A and 6B illustrate the function of the fuel passages shown in FIGS. 1 and 3.
Figure 6B:
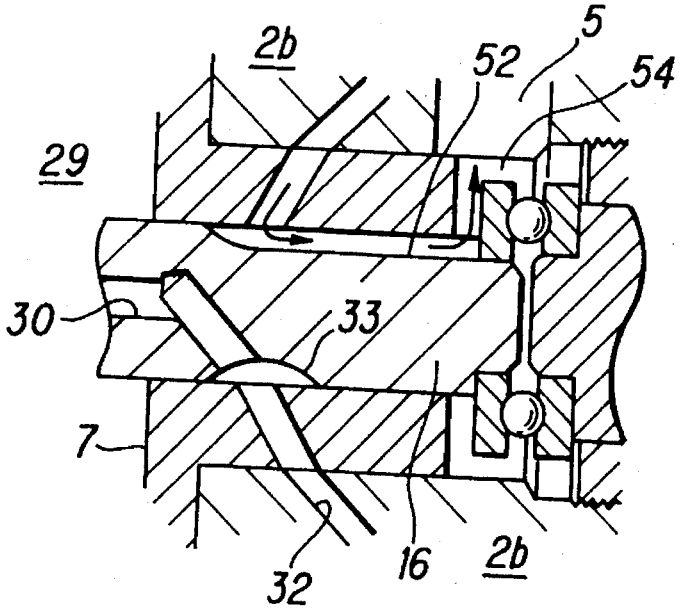

In addition, when a distribution passage 32 come into communication with the chamber 29 via a first flow passage 51 during the process in which the rotor 16 rotates, the fuel in the chamber is first induced into the distribution passage 32 via a constricted first flow passage 51, as shown in FIG. 6A. Then, when the distribution passage 32 and the circumferential area of the rotor front end 54 come into communication via a second flow passage 52 after the communication between the chamber 29 and the distribution passage 32 is cut off with the rotation of the rotor 16, the fuel temporarily led to the distribution passage 32 is induced into the low pressure fuel area 5 via the second flow passage 52, as shown in FIG. 6B. With this, fuel can be actively distributed to the area where the rotor 16 slides in contact with the rotor support member 7 from the high pressure fuel area through the low pressure fuel area, with this distributed fuel further promoting cooling of the sliding contact area. At the same time, as the rotor 16 rotates, fuel can be actively supplied to the clearance (the sliding clearance) between the rotor 16 and the rotor support member 7 as lubricating oil. This makes it possible to suppress any increase in temperature by directly cooling the sliding contact area and to prevent a reduction in viscosity of the fuel in the sliding contact area so that good lubrication can be maintained to reliably prevent seizure in the sliding contact area. Moreover, as explained earlier, since fuel is made to flow from the high pressure fuel area through the low pressure fuel area via the two flow passages with their phases offset, the reduction in fuel pressure (Pt pressure) in the chamber which would occur if only one passage was formed from the high pressure fuel area through the low pressure fuel area, can be prevented. In addition, since fuel is made to move in the sliding contact area by taking advantage of the pressure differential between the high pressure fuel area and the low pressure fuel area, it is possible to forcibly supply fuel to the sliding contact area to perform cooling and lubrication of the sliding contact area effectively.

Figure 7:
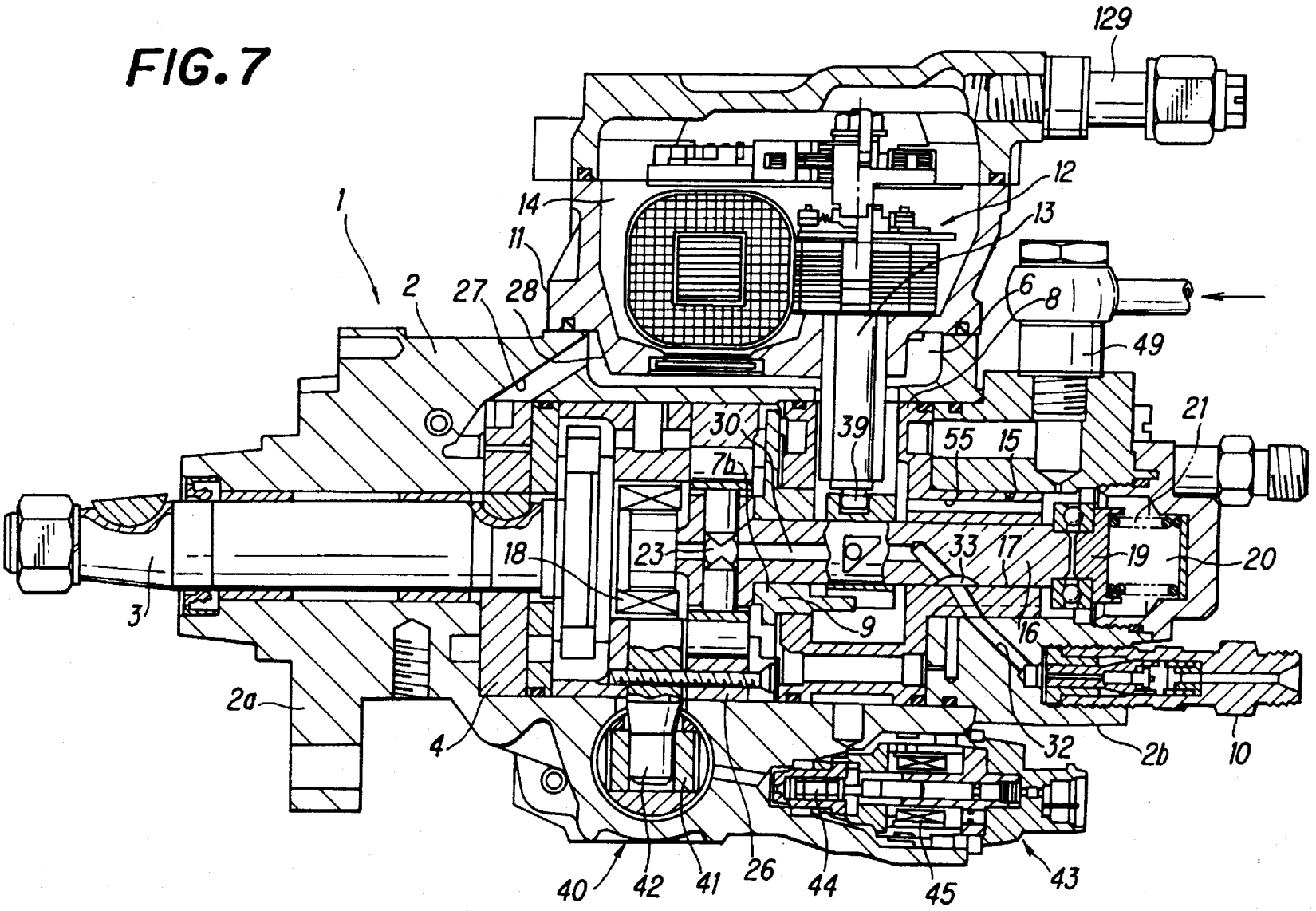
FIG. 7 is a cross section of another example of the distributor-type fuel injection pump according to the present invention.
Figure 8:
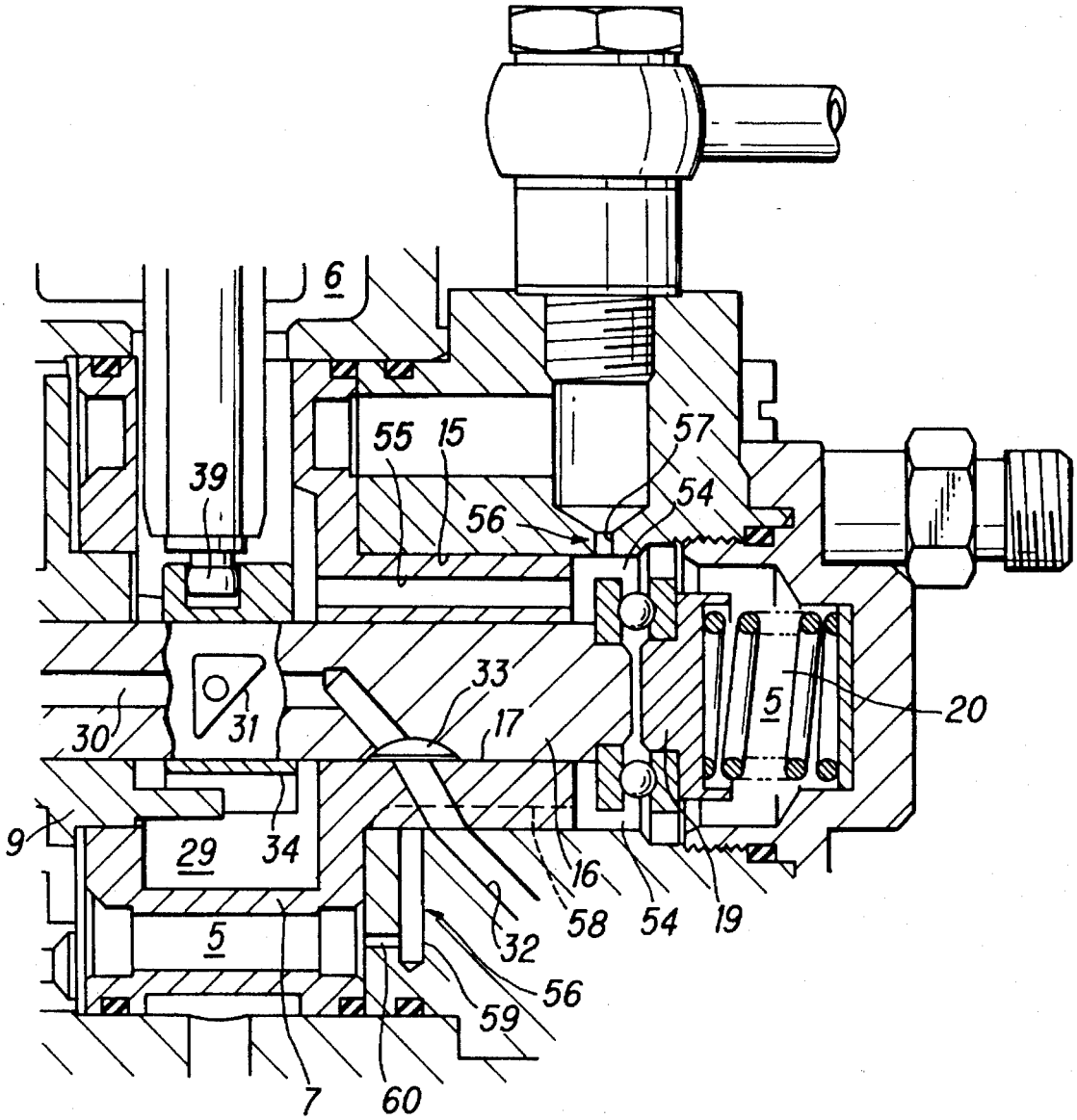
FIG. 8 is an enlarged cross section of the essential part of the distributor-type fuel injection pump shown in FIG. 7.

Another embodiment of the distributor-type fuel injection pump is shown in FIGS. 7 and 8. Mainly the differences between this embodiment and the first example are explained below. Portions where the structure is identical have been assigned with the same reference numbers and their explanation is omitted.

In this embodiment, a fuel inflow port 49 is provided above the housing member **2*b* and the low pressure fuel area 5 of the distributor-type fuel injection pump is constituted of the space bounded by the partitioning member 8, the rotor support member 7, the adaptor 9, and the space formed between the cam ring 26 and the rotor 16, the passages formed around the coupling 18 and the like. The fuel that flows in through the fuel inflow port 49 is induced toward the intake side of the feed pump 4 without traveling through the area at the front end of the rotor. In contrast, the high pressure fuel area 6 extends to the area 54 surrounding the front end of the rotor 16 and the spring housing chamber 20 via a through hole 55 which is formed in the rotor support member 7 beyond the area that, in the previous embodiment, constituted the high pressure fuel area 6**.

In such a structure, fuel will tend to become stagnant in the high pressure fuel area 6, especially in the area around the front end 54 of the rotor 16 and in the spring housing chamber 20. As a result, the temperature in the area where the rotor 16 slides in contact with the rotor support member 7 becomes higher, reducing lubrication due to a reduction in the viscosity of the fuel in the sliding contact area, and possibly causing seizure. To deal with this problem, according to the present invention, a flow passage 56 is formed in the area where fuel is likely to stagnate, i.e., the area ranging from the area 54 surrounding the front end of the rotor 16 through the low pressure fuel area 5 to induce fuel flow.

In this case, since the fuel in the high pressure fuel area 6 must be returned to the low pressure fuel area 5, it is necessary to constrict the flow passage 56 in order to prevent a reduction in the fuel pressure in the high pressure fuel area 6. Such a flow passage 56 may be constituted with an orifice 57 which communicates between the area 54 surrounding the front end of the rotor 16 and the vicinity of the fuel inflow port 49. Alternatively, it may be constituted with a passage 58, which is formed extending from the area 54 surrounding the front end of the rotor 16 and runs between the rotor support member 7 and the housing member **2*b*, a passage 59 which is bored in the housing 2*b* and an orifice 60, which communicates between the passage 59 and the low pressure fuel area 5**. Or, it may be structured to include both these configurations.

Consequently, with such a structure, the fuel in the chamber 29 is induced into the area 54 surrounding the front end of the rotor 16 via the through hole 55 and part of this fuel is made to return to the low pressure fuel area 5 via the flow passage 56. Because of this, flow of fuel in the area where the rotor 16 slides in contact with the rotor support member 7 is ensured and this flowing fuel removes the heat that is generated in the area where the rotor slides in contact with the support member to suppress any increase in temperature. This, in turn, prevents excessive reduction in the viscosity in the sliding contact area, ensuring good lubrication.

Figure 9A:
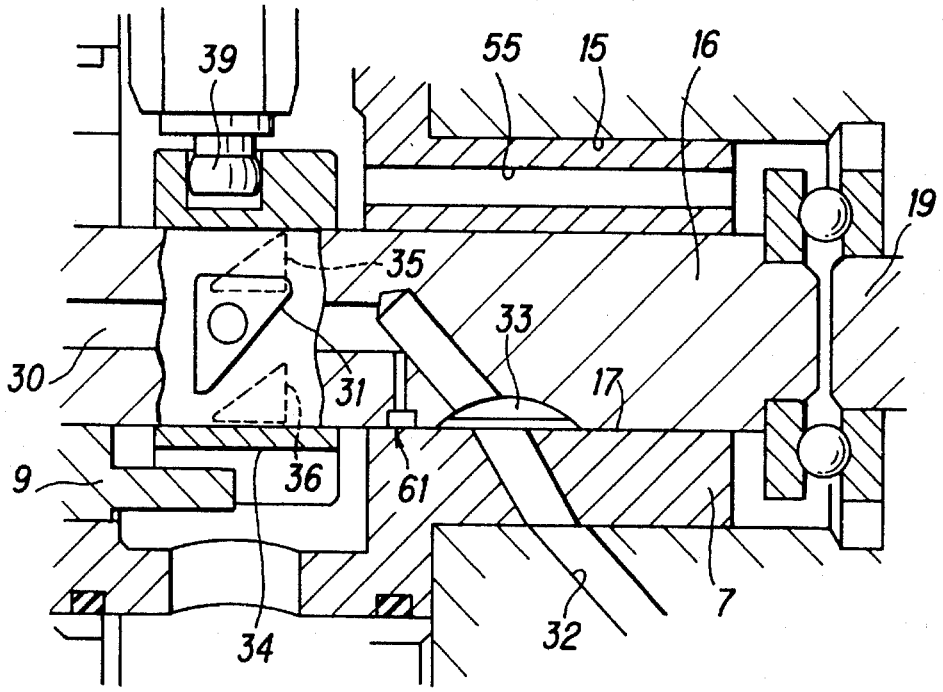
FIGS. 9*a* and 9B are enlarged cross sections of the essential parts of yet another example of the distributor-type fuel injection pump according to the present invention.
Figure 9B:
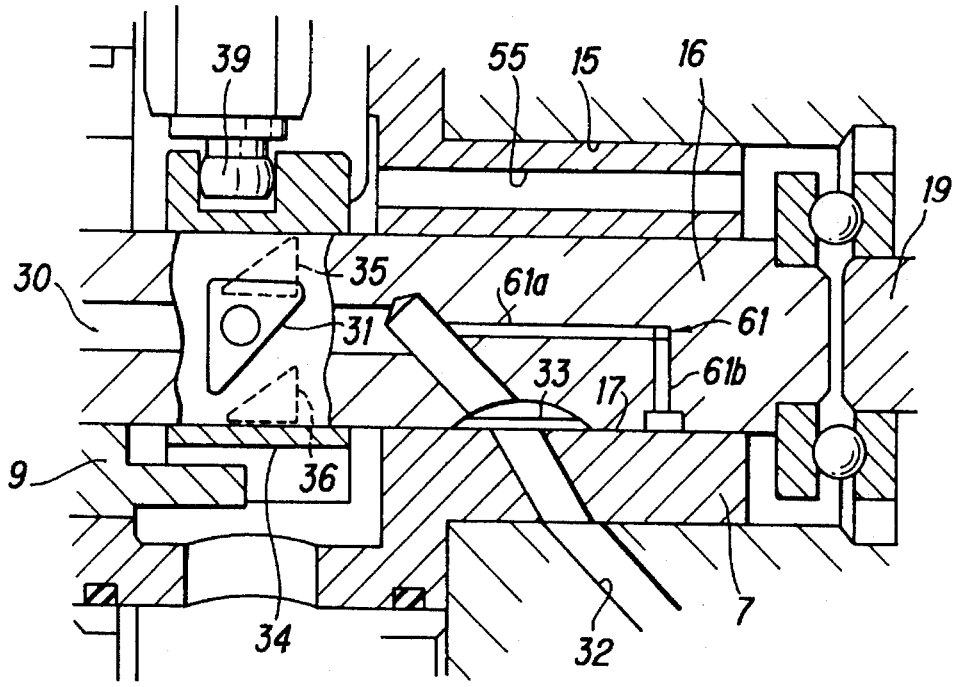
Figure 10:
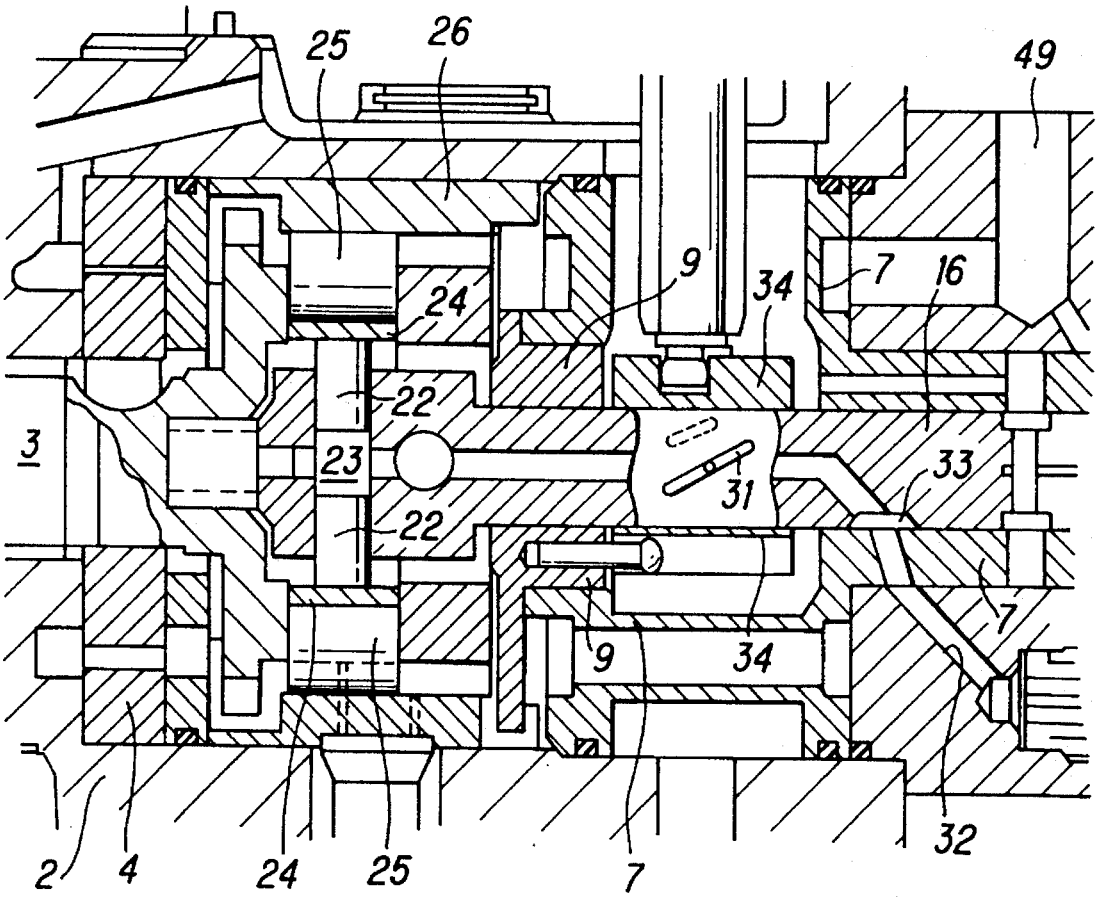
FIG. 10 is a cross section illustrating the basic structure of a distributor-type fuel injection pump which is being developed by the inventor of the present invention.

Yet another structure with which seizure in the area where the rotor 16 slides in contact with the rotor support member 7 can be prevented may be constituted as shown in FIG. 9.

In this distributor-type fuel injection pump, the passage that extends from the high pressure fuel area through the low pressure fuel area in the distributor-type fuel injection pump shown in FIGS. 7 and 8, is not provided. Instead, it is structured so that fuel is directly supplied to the sliding contact area by utilizing the injection pressure. Specifically, a port 61, with one end connected to the longitudinal hole 30 and the other end opening into the sliding contact area, is formed in the rotor 16. The portion of the port 61 that opens into the sliding contact area has a large opening area but the portion that extends from the longitudinal hole 30 to the opening end has a smaller diameter than that of the longitudinal hole 30. This constricts the passage cross section so that a reduction in injection pressure can be prevented.

Preferably, this port 61 will be provided in such a manner that it opens into he sliding contact area where seizure is particularly likely to occur. For instance, if seizure is likely to occur in the sliding contact area toward the chamber rather than toward the distribution port 33, the port 61 should be formed in the direction of the radius starting from the longitudinal hole 30 as shown in FIG. 9A. If, on the other hand, seizure is likely to occur in the sliding contact area toward the rotor front end, rather than toward the distribution port 33, a passage portion **61*a* may be bored in the direction of the axis starting from the longitudinal hole 30 with a passage portion 61*b* bored in the direction of the radius communicating with the passage portion 61*a* as shown in FIG. 9**B.

In this structure, since the port 61 communicates with the compression space 23, part of the fuel that is compressed in the compression space 23 during the force feed process is sent to the sliding contact area via the port 61 and is then forcibly supplied to the sliding contact area where it functions as lubricating oil. The fuel sent to the sliding contact area is sent to the sliding contact area via the sliding clearance between the rotor 16 and the rotor support member 7 to finally reach either the high pressure fuel area 6 or the low pressure fuel area 5, preventing an increase in the temperature in the sliding contact area and also preventing a reduction of viscosity to prevent seizure by ensuring good lubrication.

Yet another embodiment of the distributor-type fuel injection pump is shown in FIG. 11. Mainly the differences between this embodiment from the other examples are explained below. The portions where the structure is identical have been assigned with the same reference numbers and their explanation is omitted.

As in the pump structures shown in FIGS. 1 and 7, in this embodiment, too, fuel is directly supplied to the sliding contact area by utilizing the injection pressure. Namely, ports 62 and 63, each with one end connected to the longitudinal hole 30 and the other end opening into the sliding contact area, are formed in the rotor 16 with the portions that open into the sliding contact area having a large opening area and the portions which extend from the longitudinal hole 30 to the opening ends having a smaller diameter than that of the longitudinal hole 30, to constrict the passage cross section so that a reduction in injection pressure can be prevented.

Figure 11A:
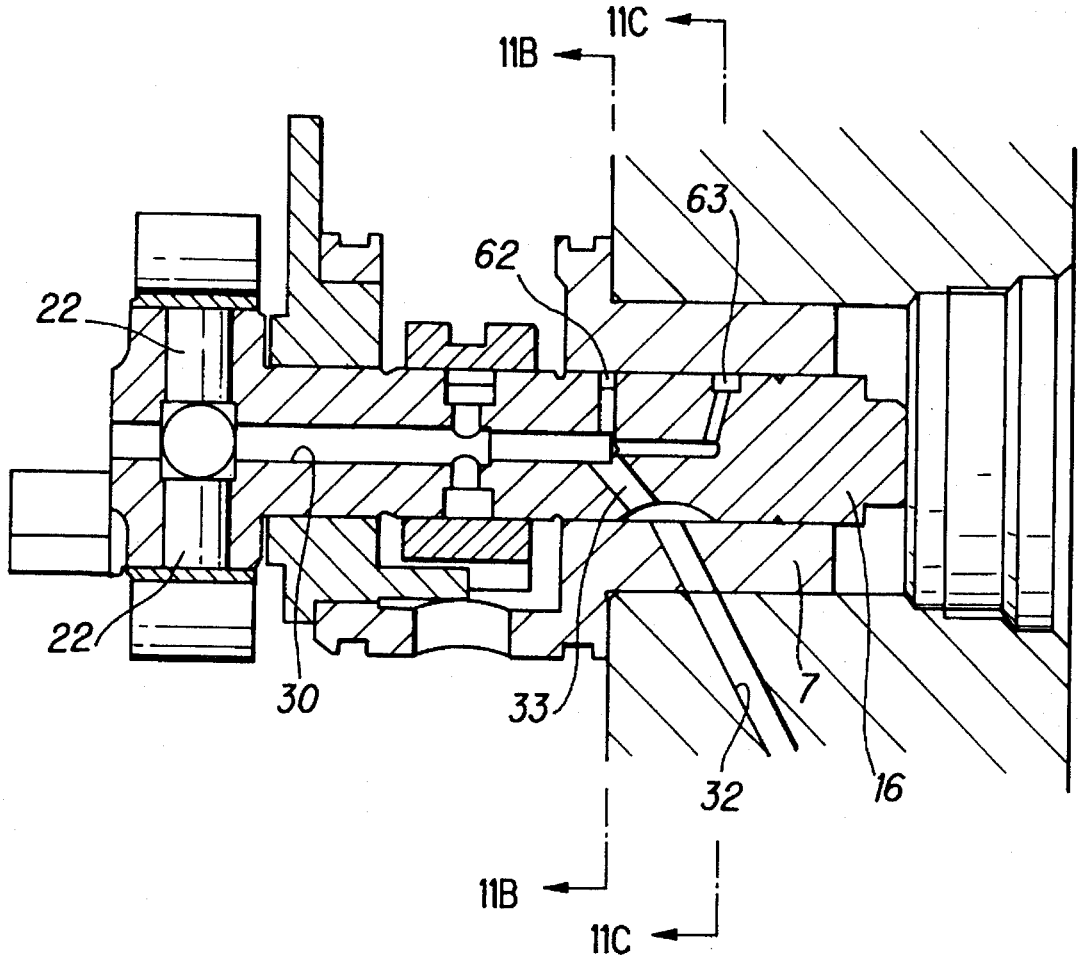
FIG. 11A is an enlarged side cross section of the essential part.
Figure 11B:
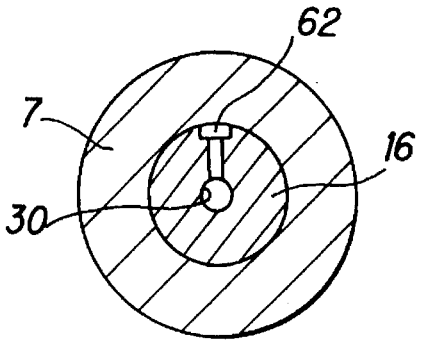
FIG. 11B is a cross section of the rotor and the rotor support member through line 11B—11B in FIG. 11A
Figure 11C:
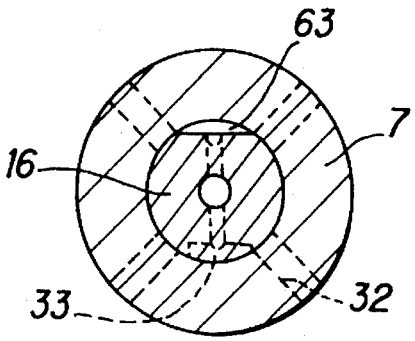
FIG. 11C is a cross section of the rotor and the rotor support member through line 11C—11C in FIG. 11A.

The ports 62 and 63 are formed at positions whose phases are different by 180° relative to the distribution port 33 and are also provided offset to the front and the rear in the direction of the axis from the distribution passages 32. In other words, as shown in FIGS. 11A and 11B, the port 62 is formed by extending in the direction of the radius from the longitudinal hole 30 toward the rotor base end rather than toward the distribution passages 32 and, as shown in FIGS. 11A and 11C, the port 63 extends over a specific length in the direction of the axis from the longitudinal hole 30 and, at the same time, extends approximately in the direction of the radius and is formed toward the rotor front end rather than toward the distribution passages 32. The total of the opening areas of the ports 62 and 63 is approximately equal to the opening area of the distribution port.

With such a structure, when the operation enters the force feed process, during which the plungers 22 move toward the center of the cam ring to supply fuel to the distribution port 33, the rotor 16, which would otherwise be pressed toward the opposite side from the distribution port 33, is not, because the ports 62 and 63, which are connected to the longitudinal hole 30, are each formed at a phase that is different from the distribution port 33 by 180°, and the fuel is also supplied to the ports 62 and 63 so that a force that presses the rotor 16 toward the distribution port 33 from the opposite side of the distribution port 33 is applied to cancel out the force that works toward the opposite side of the distribution port 33. As a result, although pressure from the fuel is applied in the direction of the radius of the rotor 16, the rotor 16 rotates in a state of zero pressure because the pressure is totally balanced and seizure between the rotor 16 and the rotor support member 7 is prevented.

Furthermore, if there were to be only one port formed at a phase different by 180° from that of the distribution port 33 in an injection pump used in a 4-cylinder engine or a 6-cylinder engine, it would be necessary to form this port at a position that is offset in the direction of the axis of the rotor 16 so that it would not communicate with the distribution port 32. In that case, the surface pressure between the rotor 16 and the rotor support member 7 would be great, due to the moment load of the rotor 16. However, if there are two ports 62 and 63 to the front and to the rear in the direction of the axis of the distribution passages 32, as in this embodiment, balance is achieved in the direction of the axis as well, to further prevent seizure.

Figure 12A:
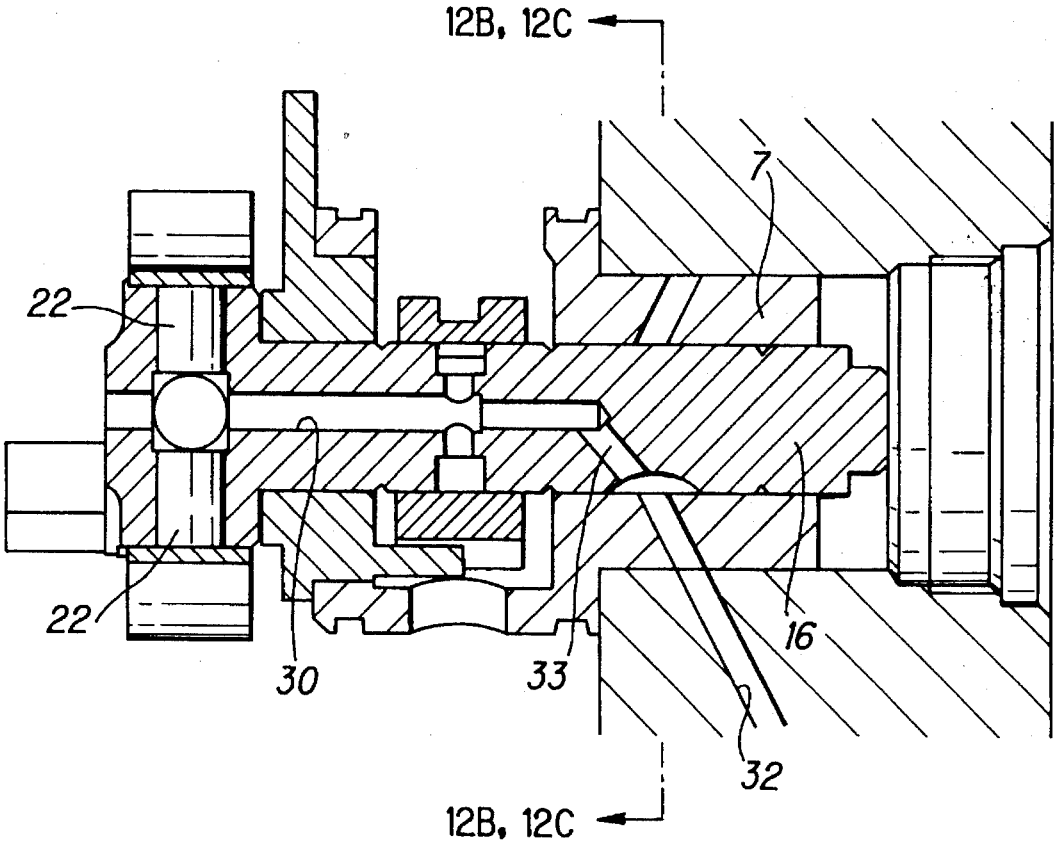
FIG. 12A is an enlarged side cross section of the essential parts.

The means for achieving a pressure balance in the direction of the radius of the rotor 16 may be constituted as shown in FIG. 12, as well. That is, in FIG. 12, two ports 64 and 65, each having one end connected to the longitudinal hole 30 and the other end opening into the rotor side surface in such a manner that it is not offset in the direction of the axis from the opening end of the distribution port 33 are formed in the rotor 16. The portions of the ports 64 and 65 that open into the sliding contact area have large opening areas but the portions that extend from the longitudinal hole 30 to the opening ends have a smaller diameter than the longitudinal hole 30, to constrict the passage cross section so that a reduction in injection pressure can be prevented.

Figure 12B:
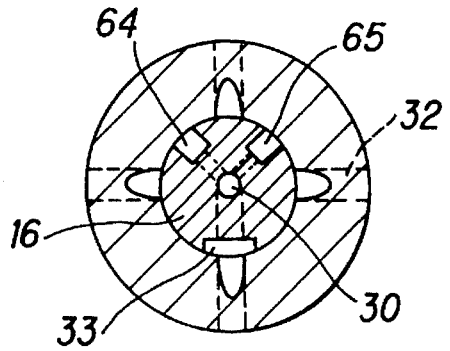
FIG. 12B is a cross section of the rotor and the rotor support member through line 12B—12B in FIG. 12A with four distribution passages and FIG. 12C is a cross section of the rotor and the rotor support member through line 12C—12C (the same as line 12B—12B in FIG. 12A) with six distribution passages.
Figure 12C:
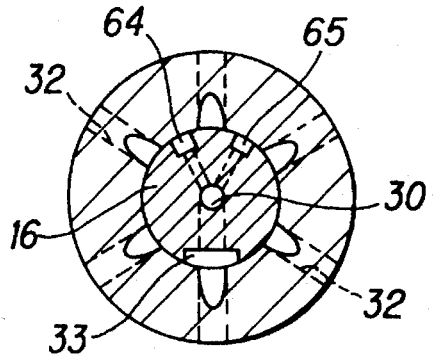

The ports 64 and 65 are formed so as to be offset symmetrically in the direction of the circumference relative to the distribution port 33 and these two ports 64 and 65 communicate with the distribution port 33 at the center of the rotor 16 to form the shape of the letter Y when projected in the direction of the axis. The ports 64 and 65 are formed in such a manner that they will not communicate with any of the distribution passages when the distribution port 33 is in communication with any one of the distribution passages 32, both in the case of a 4-cylinder engine, as shown in FIG. 12B and in the case of a 6-cylinder engine, as shown in FIG. 12C. Also, the total of the opening areas of the ports 64 and 65 is approximately equal to the opening area of the distribution port 33.

Consequently, with such a structure, when the operation enters the force feed process, during which the plungers 22 move toward the center of the cam ring to supply fuel to the distribution port 33, the rotor 16, which would otherwise be pressed toward the opposite side from the distribution port 33, is not, because fuel will also be supplied to the ports 64 and 65 so that a force is applied to the rotor 16 in the opposite direction from the direction in which the ports 64 and 65 extend. Since the ports 64 and 65 are formed symmetrically in the direction of the circumference of the rotor relative to the distribution port 33, the force that works toward the opposite side of the distribution port 33 is canceled out by the total of the forces applied by ports 64 and 65 toward the distribution port 33. As a result, although the fuel pressure is applied in the direction of the radius of the rotor 16, the rotor 16 rotates as though in a state of zero pressure because the pressure is totally balanced and seizure between the rotor 16 and the rotor support member 7 is prevented.

As has been explained, by forming a fuel flow path from the high pressure fuel area through the low pressure fuel area for cooling the area where the rotor slides in contact with its support member, the heat in the sliding contact area is removed by the fuel that flows through the fuel flow path, to prevent oil film loss by suppressing a reduction in viscosity of the lubricating oil in the sliding contact area, thereby preventing seizure.

When the low pressure fuel area is formed from the fuel inflow port that faces the circumferential area of the front end of the rotor through the upstream side of the feed pump and the fuel flow path is formed between the rotor and the support member to ensure that fuel flows from the high pressure fuel area to the circumferential area of the front end of the rotor, the fuel flows directly to the area where the rotor slides in contact with the support member to remove the heat generated in the sliding contact area. Moreover, since the fuel is induced to the sliding contact area as the rotor rotates, promoting lubrication in the sliding contact area, seizure is even more effectively prevented.

When the high pressure fuel area is provided through the circumferential area of the front end of the rotor and the fuel flow path is formed through the low pressure fuel area via the circumferential area of the front end of the rotor, a fuel flow path which extends form the high pressure fuel area through the low pressure fuel area via the circumferential area of the front end of the rotor is constituted. This means that there is not much effect whereby lubricating oil is supplied to the sliding contact area, but the cooling of the sliding contact area is promoted by the fuel that flows near the sliding contact area and with this cooling effect, seizing is prevented.

By providing ports that communicate with the compression space in such a manner that they open into the sliding contact area, it is possible to actively supply fuel that has been compressed in the compression space to the sliding contact area where seizure is likely to occur, and good lubrication in the sliding contact area is assured. In particular, the faster the pump rotates the more fuel from the compression space is supplied to the sliding contact area. Therefore, it is possible to supply lubricating oil in a suitable quantity even during high speed rotation, eliminating oil film loss in the sliding contact area and thus preventing seizure.

Moreover, since the ports whose phases are different by 180° from that of the distribution port generate a force in the rotor working toward the distribution port so that the force generated the opposite direction from the distribution port is canceled out, pressure balance in the direction of the radius is improved, preventing seizure in the area between the rotor and its support member.

If the structure is provided with a plurality of ports at phases different by 180°, offset in the direction of the axis relative to a discharge passage that can communicate with the distribution port, even when this discharge passage is formed at a position whose phase is different by 180° from the distribution port, a balance of pressures can be achieved by applying pressure toward the distribution port while ensuring that the port will not communicate with the discharge passage. Thus, seizure in the area between the rotor and its support member can be prevented. Furthermore, since a plurality of ports are formed in the direction of the axis, the pressure balance in the direction of the axis can be improved as well as the pressure balance in the direction of the radius.

Since the two ports are formed symmetrically in the direction of the circumference relative to the distribution port, the force applied in the opposite direction from the distribution port is canceled out by the total force yielded by the two ports. As a result, the balance of pressures in the direction of the radius is improved to prevent seizure in the area between the rotor and its support member. With the structure according to the present invention, even when the distribution port and the two ports are made to open into the same surface, which runs perpendicular to the direction of the axis, the problem of the distribution port and the two ports communicating with the discharge passage simultaneously can be avoided and fuel can be induced only to the intended discharge passage.

What is claimed is:

1. A distributor-type fuel injection pump comprising;

a rotor that rotates in synchronization with the engine, plungers that are provided in the direction of the radius of said rotor, which change the volumetric capacity of a compression space formed in said rotor, a cam ring that is provided concentrically to, and around said rotor which regulates the movement of said plungers, a housing for accommodating said rotor, said plungers and said cam ring, and ports that are formed in said rotor, which take in, distribute and cutoff fuel by communicating with said compression space, wherein;

the inside of said housing partitioned into a low pressure fuel area that is formed extending from a fuel inflow port toward the upstream side of a feed pump and a high pressure fuel area, into which fuel pressurized by said feed pump may be introduced and which can communicate with said ports for taking in and cutting off fuel, and a fuel flow path for cooling the area where said rotor slides in contact with a rotor support member that is formed extending from said high pressure fuel area through said low pressure fuel area.

2. A distributor-type fuel injection pump according to claim 1 wherein;

said low pressure fuel area is formed as a path that extends from said fuel inflow port, which communicates with the circumferential area of the front end of said rotor, to said feed pump via the circumferential area of said rotor support member, and said fuel flow path is formed between said rotor and said rotor support member to induce fuel from said high pressure fuel area to said circumferential area of said front end of said rotor.

3. A distributor-type fuel injection pump according to claim 2 wherein;

said fuel flow path is constituted with first flow passages and a second flow passage with their phases offset, which are formed on the circumferential surface of said rotor in an area where said port for distributing fuel is not formed, said first flow passages are formed at a length whereby a distribution passage that can communicate with said port for distributing fuel communicates with said high pressure fuel area, and said second flow passage is formed at a length whereby a distribution passage that can communicate with said port for distributing fuel communicates with said low pressure fuel area.

4. A distributor-type fuel injection pump according to claim 2 wherein;

said fuel flow path is constituted with first flow passages and a second flow passage with their phases offset, which are formed on the circumferential surface of said rotor in an area where said port for distributing fuel is not formed, said first flow passages are formed by offsetting its phase by 90° relative to said port for distributing fuel, and said second flow passage is formed by offsetting its phase by 180° relative to said port for distributing fuel.

5. A distributor-type fuel injection pump according to claim 2 wherein;

said fuel flow path is constituted with first flow passages and a second flow passage with their phases offset, which are formed on said circumferential surface of said rotor in an area where said port for distributing fuel is not formed, and said first flow passages have a more constricted passage cross section than said second flow passage.

6. A distributor-type fuel injection pump according to claim 1 wherein;

said high pressure fuel area is formed through said circumferential area of said front end of said rotor and said fuel flow path is constituted with a passage that communicates with said low pressure fuel area via said circumferential area of said front end of said rotor.

7. A distributor-type fuel injection pump according to claim 6 wherein;

said fuel flow path is constituted with an orifice that communicates between said circumferential area of said front end of said rotor and said low pressure fuel area near said fuel inflow port.

8. A distributor-type fuel injection pump according to claim 6 wherein;

said fuel flow path is constituted with a passage that is formed extending from said circumferential area of said front end of said rotor, running between said rotor support member and said housing, a passage bored in said housing and an orifice that communicates between said passage bored in said housing and said low pressure fuel area.

9. A distributor-type fuel injection pump comprising;

a rotor that rotates in synchronization with the engine, plungers that are provided in the direction of the radius of a rotor, which change the volumetric capacity of a compression space formed in said rotor, a cam ring that is provided concentrically to, and around said rotor which regulates the movement of said plungers, a housing for accommodating said rotor, said plungers and said cam ring, and ports that are formed in said rotor, which take in, distribute and cutoff fuel by communicating with said compression space, wherein;

the inside of said housing partitioned into a low pressure fuel area that is formed extending from a fuel inflow port toward the upstream side of a feed pump and a high pressure fuel area, into which fuel pressurized by said feed pump can be induced and which can communicate with said ports for taking in and cutting off fuel, and ports that open into the area where said rotor slides in contact with said rotor support member and that communicate with said compression space are provided in said rotor.

10. A distributor-type fuel injection pump according to claim 9 wherein;

said ports that open into said area where said rotor slides in contact with said rotor support member and that communicate with said compression space have smaller passage cross sections than that of said port for distributing fuel.

11. A distributor-type fuel injection pump according to claim 9 wherein;

said ports that open into said area where said rotor slides in contact with said rotor support member and that communicate with said compression space extend in the direction of the radius of a longitudinal hole formed extending from said compression space in said rotor in the direction of the axis and open into said sliding contact area toward said compression space rather than toward said port for distributing fuel.

12. A distributor-type fuel injection pump according to claim 9 wherein;

said ports that open into said area where said rotor slides in contact with said rotor support member and that communicate with said compression space extend in the direction of the axis beyond a longitudinal hole formed by extending from said compression space in said rotor in the direction of said axis, then extends in the direction of the radius from the portion that extends in the direction of said axis and formed in said sliding contact area toward the front end of said rotor rather than toward said port for distributing fuel.

13. A distributor-type fuel injection pump according to claim 9 wherein;

said ports that open into said area where said rotor slides in contact with said rotor support member are formed at positions whose phases are different by 180° relative to said port for distributing fuel.

14. A distributor-type fuel injection pump according to claim 13 wherein;

a plurality of said ports whose phases are different by 180° relative to said port for distributing fuel are provided by offsetting them to the front and to the rear in the direction of said axis relative to a passage that can connect with said port for distributing fuel.

15. A distributor-type fuel injection pump according to claim 14 wherein;

said ports whose phases are different by 180° relative to said port for distributing fuel are provided with one being offset to the front and the other to the rear in the direction of said axis relative to said passage that can connect with said port for distributing fuel and with the total of the opening areas of said two ports being approximately equal to the opening area of said port for distributing fuel.

16. A distributor-type fuel injection pump according to claim 9 wherein;

said ports that open into said area where said rotor slides in contact with said rotor support member comprise two ports that are offset symmetrically in the direction of the circumference relative to said port for distributing fuel with said two ports communicating with said port for distributing fuel at the center of said rotor to form the shape of the letter Y when projected in the direction of said axis.

17. A distributor-type fuel injection pump according to claim 16 wherein;

the total of said opening areas of said ports that are offset symmetrically in the direction of the circumference relative to said port for distributing fuel is approximately equal to said opening area of said port for distributing fuel.

* * * * *